United States Patent [19]

Dubois

[11] 4,390,333

[45] Jun. 28, 1983

[54] APPARATUS SUITABLE FOR USE IN CLOSING OPENINGS WITH A FOAM-EXPANDED BLADDER

[75] Inventor: Michel A. J. Dubois, Saint Pierre de Chandieu, France

[73] Assignee: Esso Societe Anonyme Francaise, Paris, France

[21] Appl. No.: 231,780

[22] Filed: Feb. 5, 1981

[30] Foreign Application Priority Data

Feb. 5, 1980 [FR] France ..... 80 02444

[51] Int. Cl.[3] ..... B32B 35/00

[52] U.S. Cl. ..... 425/11; 156/78; 156/94; 156/156; 156/287; 156/293; 141/10; 141/313; 141/329; 220/239; 222/174; 222/191; 114/227; 264/36; 264/45.2; 264/46.6; 264/46.9; 264/314; 425/12; 425/13; 425/817 R; 425/DIG. 36; 428/63

[58] Field of Search ..... 92/92; 138/93; 156/78, 156/94, 156, 285, 287, 293; 141/2, 10, 21, 22, 67, 68, 313, 329; 220/239; 222/1, 174, 191, 207, 210, 215; 264/491, 544, 36, 45.2, 46.6, 46.9, 314; 405/261; 425/11, 12, 13, 27, DIG. 14, DIG. 36, 817 R; 114/227; 428/63

[56] References Cited

U.S. PATENT DOCUMENTS

| | | | |
|---|---|---|---|
| 3,419,134 | 12/1968 | Fitts | 206/47 |
| 3,698,196 | 10/1972 | Jankowski et al. | 405/261 |
| 3,964,643 | 6/1976 | Morane et al. | 222/145 |
| 4,012,822 | 3/1977 | Vrolyk et al. | 156/94 X |
| 4,329,132 | 5/1982 | Melvold et al. | 425/13 |

FOREIGN PATENT DOCUMENTS

| | | |
|---|---|---|
| 2461617 | 12/1974 | Fed. Rep. of Germany . |
| 2196632 | 10/1972 | France . |
| 398453 | 10/1961 | Switzerland . |
| 391534 | 12/1931 | United Kingdom . |
| 961196 | 10/1960 | United Kingdom . |
| 1059563 | 9/1963 | United Kingdom . |
| 1009779 | 10/1964 | United Kingdom . |
| 1239219 | 9/1967 | United Kingdom . |
| 1435352 | 3/1973 | United Kingdom . |
| 1556165 | 12/1975 | United Kingdom . |
| 1516051 | 12/1976 | United Kingdom . |
| 2013619 | 1/1979 | United Kingdom . |

*Primary Examiner*—Robert A. Dawson
*Attorney, Agent, or Firm*—Donald F. Wohlers

[57] ABSTRACT

A hole, particularly an accidental perforation, is closed by manoeuvering a bladder (g) into the hole employing a hollow rod (f) on which the bladder is mounted at one end. An operator operating from the other end of the rod actuates a device such as a triggered valve to cause the components of a settable foamed plastics material to pass (via tubes b and rod f) from their sources (in a) to fill the bladder (g) so that it closes the hole. The settable foamed plastics material is preferably polyurethane foam. The bladder may be of natural or synthetic rubber and may be protected against tearing by a textile envelope. The sources of foamed plastics material may be either in a portable kit (a) or rupturable containers within the bladder (g) or rod (f).

8 Claims, 9 Drawing Figures

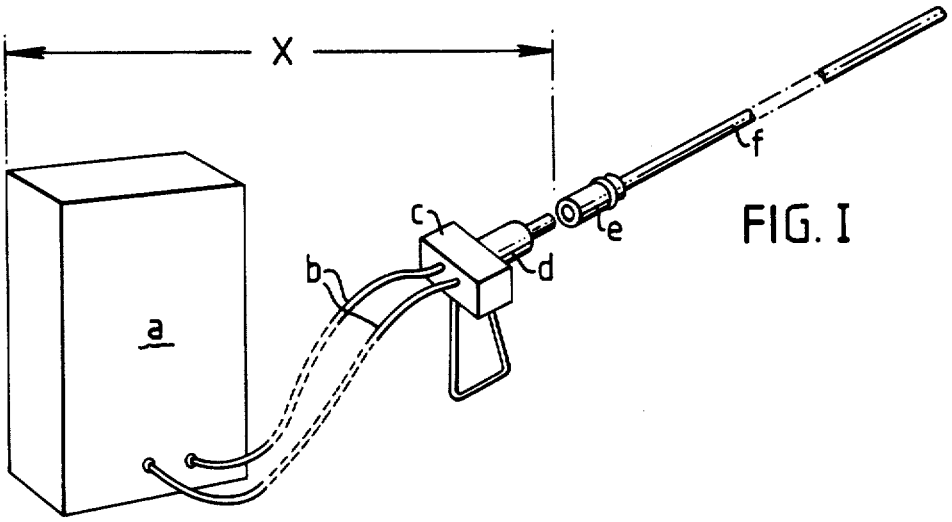
FIG. I
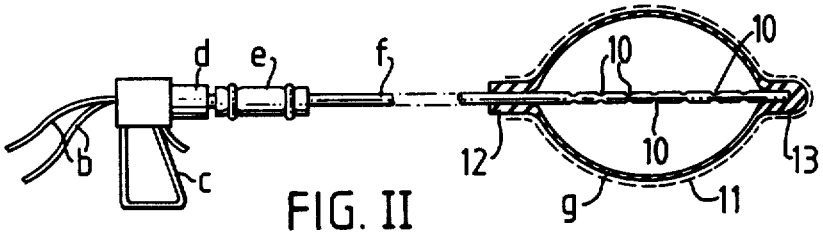
FIG. II
FIG. III
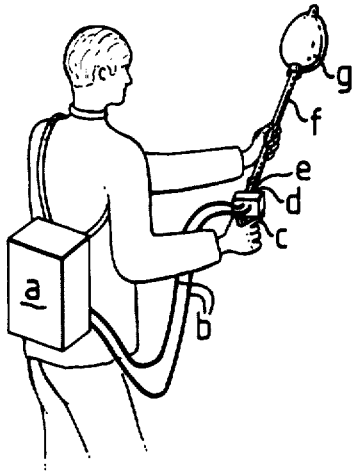

FIG. IV
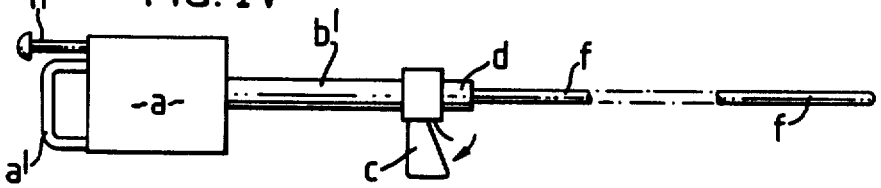
FIG. V
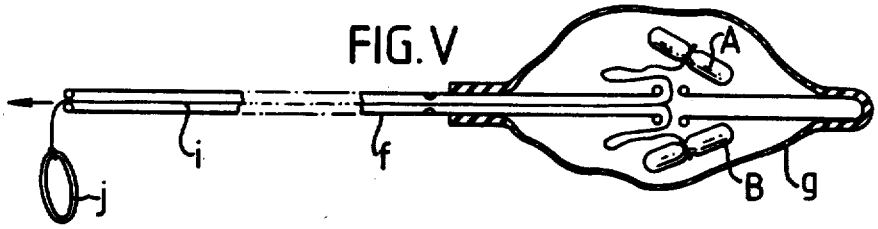
FIG. VI
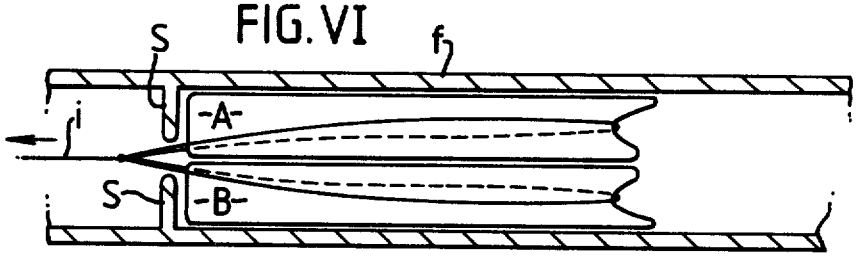
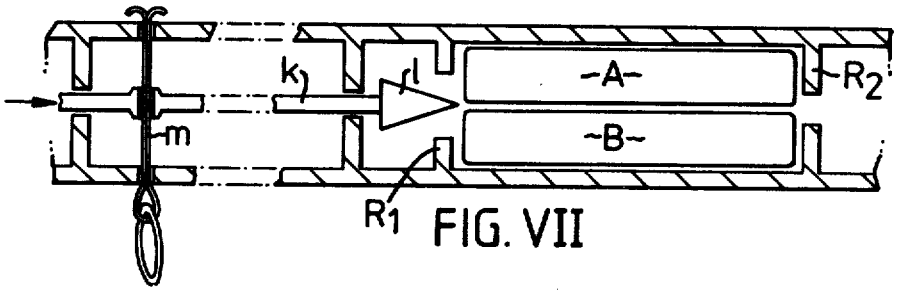
FIG. VII
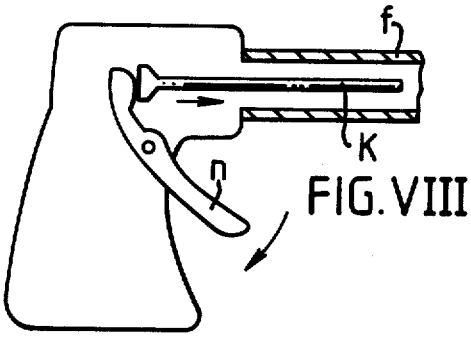
FIG. VIII
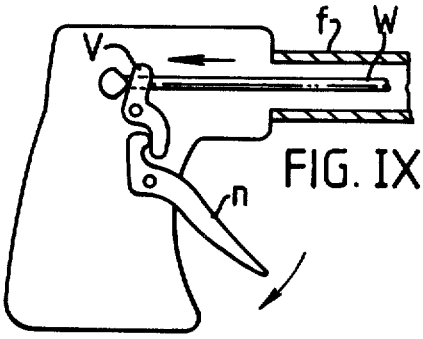
FIG. IX

APPARATUS SUITABLE FOR USE IN CLOSING OPENINGS WITH A FOAM-EXPANDED BLADDER

The present invention relates to an apparatus and a method for use in closing a hole. The apparatus and method of the invention are particularly, but not exclusively, useful for closing holes (and like openings) in the walls of storage tanks, more especially holes caused by the accidental rupture or tearing of such walls, wherein the hole is usually of an irregular shape.

In one aspect, the present invention provides apparatus for use in closing a hole, comprising (a) a bladder; (b) a source of settable foam plastics material connected or connectible to the bladder and operable so as to be able to fill the bladder with settable foam plastics material; (c) a substantially rigid rod for mounting the bladder at one end thereof so that the bladder can be manoeuvered into the hole by an operator (human or mechanical) at the other end thereof; and (d) operating means at the said other end of the rod for operating the said source to fill the bladder with settable foam plastics material.

In another aspect, the invention provides a method of closing a hole comprising the steps of manoeuvering a substantially empty bladder mounted at one end of a rigid rod at least partially into the hole, said manoeuvering being effected from the other end of the rod, and operating an operating means from the other end of the rod so that settable foam plastics material fills the bladder and thereby closes the hole.

The said source of settable foam plastics material may be either at the said one end of the rod, e.g. at least adjacent to the bladder, or at or connectible to, the said other end of the rod.

When the said source is at the said one end of the rod, it may be separate from the bladder, and there may be provided at least one valve for providing communication between the source and the bladder, the valve being openable (and closable) by the action of said operating means. Alternatively, the source may be at least partially within the bladder and the operating means may then be operable to provide communication between the source and the interior of the bladder, e.g. by rupturing the common walls of the source and the interior of the bladder so that substances which react to form the settable foam plastics material mix and react with each other within the bladder.

When the source is at, or connectible to, the said other end of the rod, the rod may be hollow for the passage of settable foam plastics material (and/or precursors thereof) therethrough from the said other end of the rod to the interior of the bladder at the said one end thereof.

The source may be connected or connectible to the said other end of the rigid rod by a flexible tube.

Preferably, at least one valve is provided for controlling and regulating the operation of the source.

The source may be sufficiently small and/or light to be portable and it may be furnished with carrying means such as a harness or shoulder strap whereby at least one of the operator's hands is left free to manoeuvre and/or operate the apparatus, e.g. from a distance apart from the hole which is to be closed.

The bladder is preferably of an impervious material which is preferably slightly elastic. Suitable materials include natural or synthetic rubber, inter alia. The elasticity improves the obturation of the hole when the bladder is filled with the settable foam plastics material. The bladder may be enclosed by a protective net or textile cover or envelope for protection against tearing. Such protection is particularly useful (but not essential) when the hole to be closed has jagged, sharp and/or irregular edges which might tear the bladder. Suitable textiles are cotton, polyamide (e.g. nylon), inter alia.

The settable foam plastics material may be of any type suitable for the anticipated uses of the apparatus and method of the invention. For example, it may be polyurethane foam generatable from the source which contains the chemical reactant precursors thereof in respective containers or compartments.

Preferably, the apparatus is relatively portable, easily assembled and may be furnished as a kit for rapid deployment in the event of the perforation or rupture of a tank or pipe. For example, the rod, source and bladder may be at least partially connected and located in a convenient part (e.g. in or immediately outside the cab) of a road tanker carrying liquids in bulk so that in the event of an accident in which the tank is holed, the bladder can be rapidly deployed into the hole from a safe distance and then filled with the settable foam plastics material to prevent continued spillage of liquid therethrough. When the foam plastics material has set, the hole will be substantially plugged. It has been noted that the inflated bladder tends to be swollen to slightly greater dimensions than those of the hole on each side of the holed wall; this is advantageous in maintaining the inflated bladder in place.

A large or very irregularly shaped hole may be closed by more than one bladder in abutment within the hole.

The invention is now further described with reference to some embodiments thereof, given by way of non-limitative example and with reference to the accompanying diagrammatic drawings in which:

FIG. I shows one form of apparatus of the invention with the bladder omitted;

FIG. II shows part of the apparatus of FIG. I with the bladder in place and depicted in cross-sectional elevation;

FIG. III shows the apparatus of FIGS. I and II completed and being manipulated for use by a human operator;

FIG. IV depicts an alternative form of the part of the apparatus shown in FIG. I;

FIG. V depicts an alternative form of the part of the apparatus shown in FIG. II;

FIG. VI is a diagrammatic cross-sectional view of a part of a rigid tube intended to be disposed within the bladder;

FIG. VII is an alternative form of the part shown in FIG. VI;

FIG. VIII depicts, diagrammatically, an arrangement for causing operation of the part shown in FIG. VII; and FIG. IX depicts diagrammatically an arrangement for causing operation of the part shown in FIG. V and/or FIG. VI.

Reference is first made to FIG. III which shows a human operator furnished with a settable foam plastics generating kit a in the form of a back-pack carried by a shoulder strap. Flexible pipes b connect the kit a to a pistol grip c, the components of the settable foam plastics material being mixed in a nozzle d. A flexible hollow connector e receives the mixed foaming plastics components at one end and passes the components from the other end into one end of a rigid tube f received in the connector e. The connector e may be of rubber or plastics material which is substantially inert relative to the components of the foam plastics material passing therethrough. The rigid tube f may be of any convenient metal e.g. copper, steel, aluminium and alloys of the foregoing metals. The aluminium alloy known by the trade name "Duralumin" has been found to provide satisfactory strength, a relatively low weight and cost for use in the apparatus of the invention. Alternatively, rigid plastics and fibreglass materials may be employed for tube f. The end region of the tube f remote from the flexible connector e is provided with radial apertures in its walls for foam plastics material to pass radially out of the end region of the tube f into the bladder which surrounds the said end region.

In FIG. II, the apertured said end region of the rigid tube f is shown received in the bladder g. The radial apertures 10 in the tube f may be circular or slits (preferably parallel to the axis of the tube f). The bladder g may be of any flexible, preferably slightly elastic, impervious material which is substantially inert with respect to the foam plastics material and its precursors. Suitable materials are natural and synthetic rubbers (e.g. neoprene) and some plastics and other synthetic polymeric materials. The bladder g is formed with a tubular opening 12 for receiving the tube f with a relatively close fit, and with a pocket 13 opposite the opening 12 in which the tip of the tube f is received. The tip of the tube f may be open, but more preferably, it is closed by a member (not shown) which is relatively smooth on its outer face to prevent damage to the bladder g in the vicinity of the tube tip. The member may be a smooth headed rivet of aluminium, plastics material or other suitable solid having the shank received in the open tip of the tube f and the head closing off the tip of the tube.

Preferably, the bladder g is covered by a protective envelope 11 of textile (e.g. a net or fabric of polyamide, polyester, cotton or a mixture of any two of the foregoing).

Referring to FIGS. I and II, it will be appreciated that when the apparatus is assembled for use, depression of the hand-trigger at the pistol-grip c will cause components of the foam plastics material to pass from the pack a via tubes b to the nozzle d wherein the components mix, the mixed components then passing via the flexible connector e and tube f into the interior of the bladder via the radial apertures 10.

The apparatus of the invention may be stored for use in a partially disassembled form so as to be ready to deploy for use at short notice. For example, the plastics-foam generating kit a, tubes b, grip c and nozzle d may be stored as a single unit, as indicated by "X" in FIG. I, and one or more tubes f of various lengths may be separately stored, and each may have a flexible connector e thereon, or if the tubes f are all of the same diameter, a single connector e may be stored conveniently as part of the unit X. Similarly, there may be one or more bladders g, preferably a plurality which may each be of different sizes for use in closing different size holes. Each bladder may be mounted at the end of a respective rigid tube f or, less preferably, it may be stored separately.

Since the apparatus of the invention is particularly suitable for use in closing a hole in an emergency, it is preferred that the number of parts to be connected to assemble the complete apparatus should be small, and for use on a road tanker carrying bulk liquids, the apparatus may be stored in the driver's cab and/or at a convenient location outside the cab in an assembled condition or in two parts for assembly, one part being the unit X and including the connector e, and the other part being one or more rods f with bladders g mounted on their ends.

FIG. III shows the apparatus of FIGS. I and II being manoeuvered for use. The kit a is carried on the operator's back leaving his hands free. One hand is used to operate the trigger of the pistol grip c and the other hand is used to manoeuvre the bladder g into a hole which is to be closed by the bladder when the latter is inflated. The length of the rod f is chosen so that the operator can manoeuvre the bladder reasonably accurately from a reasonably safe distance and without any substantial risk that the rod will snap as a result of the loads imposed thereon. It will be appreciated that because the apparatus of the invention is intended particularly for use in an emergency, the optimum length of the rod has to be estimated from the type of emergency to be dealt with, and no hard and fast rules can be given in this regard. The rod f may be formed from a number of smaller hollow rods joined, e.g by screw-joints, bayonet joints, push-fit, inter alia, to a suitable length.

The apparatus of FIG. IV is similar to the corresponding parts shown in FIGS. I and II except that the foamed plastics-producing kit a is connected by a more or less rigid connector b' to the pistol grip c and has a carrying handle a'. A knob h protrudes from kit a and when sharply struck (e.g. by striking downwardly onto the ground), causes components of the foam-plastics material to pass via connector b' to the pistol grip c where the trigger controls the components to pass via the nozzle d to the bladder (not shown) via the rigid tube f. In a variation of this embodiment (not shown) which will be apparent to the skilled worker in this field, the pistol grip and nozzle assembly can be incorporated as part of the kit a.

In FIG. V, the apparatus comprises a rigid hollow tube f with a bladder g mounted at one end, the components of the settable foam plastics mixture being disposed in discrete containers A and B within the bladder. Each container is connected by a cord or wire passing through a radial aperture of the rod f to a cord or wire i within the hollow interior of the rod f within the bladder g at one end thereof, the other end of the cord or wire i protruding from the other end of the rod f and terminating in a suitable pull j. As depicted, the interior of the rod f may have a plurality of apertured members in the form of rings to act as guides for smooth movement in the tube f of the cord or wire i and to prevent tangling thereof.

When the pull j is engaged to pull the cord or wire i through the tube f, the containers A and B become engaged against the outer surface of the tube f within the bladder and eventually rupture so that their contents mix within the bladder and thereby fill the bladder with settable foamed plastics material. The containers A and B may be of a frangible material such as glass, or they may have a line of weakness defining an openable portion, or they may have a removable opening, or they may be of a tearable material such as a relatively soft plastics material. The embodiment of FIG. V has the merit of being very simple to operate, and of low weight.

In the embodiment of FIG. VI, the containers A and B for the components of the foamed plastics material are disposed within the hollow rod f, the adjacent end of which has one or more large openings (not shown) for the passage of the foaming plastics mixture from the interior of the rod f to the interior of the bladder (not shown). The containers A and B are connected to the cord or wire i by respective cords or wires such that when the cord or wire i is pulled towards the operator's end (to the left as shown in FIG. VI) of the rod f, the containers A and B are abutted against an annular stop S within the rod f whereby they are opened or ruptured. The construction and/or arrangement of the containers A and B, and of the stop S, is/are such that on opening or rupture of the containers A and B, the contents thereof mix and react to form the settable foamed plastics material to the right of the stop S, the continued reactions producing the foamed plastics material causing the reactants and products to pass through the adjacent aperture(s) in the rod f into the bladder which is thereby filled.

FIG. VII depicts a similar arrangement to that of FIG. VI except that the containers A and B are retained between two rings $R_1$ and $R_2$. Ring $R_2$ which is nearest to the aperture(s) providing communication between the interior of the tube f and the interior of the bladder (not shown) is of sufficient radial width to retain the containers A and B but also provides a central aperture of adequate size to permit the contents of the containers A and B, after mixing, to form settable foamed plastics material and precursors thereof which can pass into, and fill, the bladder. The contents of containers A and B are brought into contact with each other by breaking or rupturing the containers. As depicted, a blade or cone L is disposed adjacent to the containers A and B. The blade or cone L is mounted at the end of a relatively rigid link K which is slidably mounted within tube f and normally restrained against movement by a locking pin m extending through the link K and engaging with diametrically opposite walls of the rigid tube f.

When it is desired to inflate a bladder (not shown) with foamed plastics material, the bladder is mounted on the end of the rod f so as to enclose the aperture(s) which provide communication between the interior of the rod and the interior of the bladder. The locking pin m is withdrawn and the link k slid to the right (as shown) so that the containers A and B are both cut or crushed or ruptured (e.g. by abutment against ring $R_2$) whereupon the contents of the containers mix and react to form the foamed plastics material and precursors thereof which passes into, and fills, the bladder.

The sliding movement of the link K of FIG. VII can be effected by direct manual operation of the link. Alternatively, the sliding movement may be effected by indirect manual operation via a trigger and/or lever arrangement as diagrammatically shown in FIG. VIII, wherein the movement of a trigger n causes a lever-extension thereof to push the link K to the right. It will be appreciated that when a trigger arrangement is provided, such as that shown in FIG. VIII, the locking pin m may be replaced by a safety catch (not shown) associated with the trigger and arranged so as normally to prevent movement of the trigger.

A trigger-type mechanism can also be employed to operate the embodiments of FIGS. V and VI by exerting a pull on the wire or cord i when the trigger is depressed or pulled. An arrangement for effecting this is diagrammaticaly depicted in FIG. IX. It may be convenient to attach the wire or cord i either directly to the trigger lever V or indirectly thereto via a link W. A locking pin or safety catch is preferably provided as described with reference to FIGS. VII and VIII.

The apparatus of the invention has been successfully used in trials on road tankers carrying bulk liquids (water was used to simulate hazardous and/or valuable liquids such as gasoline and other inflammable and/or corrosive liquids). Using apparatus of the type described with reference to FIG. I except that the kit a was rested on the ground rather than carried by the operator, and with a bladder mounted at the end of a duralumin rod of length about 130 cms and diameter about 7 mms, it was possible to close an irregular hole about 13 cms × 7 cms and to stop loss of liquid in a few seconds. The kit used was a commercially-available foamed polyurethane kit sold under the name "Froth-Pak" and manufactured by Insta-Foam Products Inc., of Joliet, Illinois, USA. Clearly the invention makes a worthwhile contribution to safety and it would be advantageous to equipment all stationary and mobile facilities storing liquids which are hazardous and/or valuable with apparatus according to the invention so that apertured liquid-holding tanks can be at least partially closed within a short time and without personnel having to operate at the aperture.

I claim:

1. Portable apparatus for use in closing a hole in a vessel, comprising an expandable bladder of impervious elastic sheet material;

an elongated substantially rigid tubular rod for mounting the bladder at one end thereof so that the bladder can be manoeuvered into the hole from a distance from said hole by an operator at the other end thereof;

a source of settable foam plastic material constituents located within said one end of said tubular rod within said bladder, said source comprising at least two rupturable containers containing said constituents;

and operating means at the said other end of the rod for rupturing the said containers to allow their contents to mix and expand into a foam plastic material and thereby expand and fill the bladder within said hole.

2. The apparatus of claim 1 wherein said operating means includes a wire within said tubular rod secured to each of said rupturable containers.

3. The apparatus of claim 1 wherein said operating means includes a rigid rod member within said tubular rod having a triangular container piercing member at the end thereof.

4. The apparatus of claim 1 wherein said bladder includes a textile net cover on the exterior thereof for rupture protection of said bladder when expanded in said hole.

5. A portable apparatus for use in closing a hole in a vessel, comprising an expandable bladder of a single sheet of impervious elastic material;

an elongated substantially rigid tubular rod for mounting the bladder at one end thereof so that the bladder can be manoeuvered into the hole from a distance from said hole by an operator at the other end thereof, said tubular rod including internal stop means proximate said one end;

a source of settable foam plastic material constituents located within said one end of said tubular rod adjacent said stop means, said source comprising at least two rupturable containers containing said constituents;

and operating means mounted on and integral with the said other end of the rod for compressing the said containers against said stop means to rupture said containers to allow their contents to mix and expand into a foam plastic material and thereby expand and fill the bladder within said hole.

6. The apparatus of claim 5 wherein said bladder includes a textile net cover on the exterior thereof for rupture protection of said bladder when expanded in said hole.

7. A portable apparatus for use in closing a hole in a vessel, comprising an expandable bladder of a single sheet of impervious elastic material;

an elongated substantially rigid tubular rod for mounting the bladder at one end thereof so that the bladder can be manoeuvered into the hole from a distance from said hole by an operator at the other end thereof, said tubular rod including at least one radial aperture located within said bladder;

a source of settable foam plastic material constituents located within said bladder and outside said rod adjacent said radial aperture, said source comprising at least two rupturable containers containing said constituents;

and operating means mounted on and integral with the said other end of the rod for compressing the said containers against said radial aperture to rupture said containers to allow their contents to mix and expand into a foam plastic material and thereby expand and fill the bladder within said hole.

8. The apparatus of claim 7 wherein said bladder includes a textile net cover on the exterior thereof for rupture protection of said bladder when expanded in said hole.

* * * * *